US010947105B2

(12) United States Patent
Nilov

(10) Patent No.: US 10,947,105 B2
(45) Date of Patent: Mar. 16, 2021

(54) HAND HELD, VOLUMETRIC MULTI MATERIAL DISPENSER

(71) Applicant: Maksim Nilov, Princeton, NJ (US)

(72) Inventor: Maksim Nilov, Princeton, NJ (US)

( * ) Notice: Subject to any disclaimer, the term of this patent is extended or adjusted under 35 U.S.C. 154(b) by 0 days.

(21) Appl. No.: 16/664,931

(22) Filed: Oct. 27, 2019

(65) Prior Publication Data

US 2020/0165119 A1 May 28, 2020

Related U.S. Application Data

(60) Provisional application No. 62/770,816, filed on Nov. 22, 2018.

(51) Int. Cl.
*B67D 3/00* (2006.01)

(52) U.S. Cl.
CPC ..... *B67D 3/0045* (2013.01); *B67D 3/0012* (2013.01)

(58) Field of Classification Search
CPC ..... B67D 3/0045; B67D 3/0012; B67D 7/70; B65D 88/54; G01F 11/00; B01F 2215/995; B01F 13/002; B01F 13/1058; B01F 15/0237
USPC .... 222/135, 142.6–142.9, 144.5, 145.7, 137, 222/134, 145.5, 145.3, 145.1, 282, 287, 222/288; 604/187, 191, 207, 208, 211, 604/218
See application file for complete search history.

(56) References Cited

U.S. PATENT DOCUMENTS

| | | | | |
|---|---|---|---|---|
| 3,353,716 | A * | 11/1967 | Fuchs, Jr. | B67D 7/741 222/132 |
| 3,718,234 | A * | 2/1973 | Bagguley | B65D 83/384 222/135 |
| 4,392,589 | A * | 7/1983 | Herold | A61C 5/64 222/137 |
| 5,429,276 | A * | 7/1995 | Esclar | B01F 5/0685 222/1 |
| 6,464,107 | B1 * | 10/2002 | Brugger | B05B 11/3056 222/134 |
| 8,651,338 | B2 * | 2/2014 | Leak | A61M 5/19 222/309 |
| 9,346,069 | B2 * | 5/2016 | Holzmann | B05B 11/3056 |
| 9,402,961 | B2 * | 8/2016 | Leak | A61M 5/31525 |
| 10,584,023 | B2 * | 3/2020 | Beyda | B67D 3/0064 |
| 10,602,830 | B2 * | 3/2020 | Giron | B01F 5/0641 |
| 2012/0031925 | A1 * | 2/2012 | Greenberg | B65D 83/68 222/135 |

(Continued)

*Primary Examiner* — Lien M Ngo
(74) *Attorney, Agent, or Firm* — Michael J. Feigin, Esq

(57) ABSTRACT

A fluid dispenser which enables one or two liquid mixture components to be selectively or simultaneously dispensed via a manually operable selection and actuation means. The said dispenser incorporates a body, one or more fluid storage and delivery channels, a selection and actuation disc operable to cause the release of a quantity of a stored fluid, as well as articulation and clamping means which support the said disc. One or more of the said fluid channels may be urged by said disc via cams to eject a fluid or fluids from corresponding cartridges. The present device provides a scale and pointer system which permits selection of a particular volume of a fluid for ejection in a first mode of operation, or selection of a specified mutual proportion of two fluids for ejection in a second mode of operation.

7 Claims, 6 Drawing Sheets

(56) References Cited

U.S. PATENT DOCUMENTS

2012/0241472 A1* 9/2012 Nilov ..... F04B 9/14
222/95
2012/0298694 A1* 11/2012 Holzmann ..... B05B 11/3095
222/135
2018/0056312 A1* 3/2018 Hou ..... B05B 15/70

* cited by examiner

HAND HELD, VOLUMETRIC MULTI MATERIAL DISPENSER

CROSS-REFERENCE TO RELATED APPLICATION(S)

This application claims the benefit of U.S. Provisional Patent Application No. 62/770,816, filed Nov. 22, 2018, which is incorporated by reference herein in its entirety.

BACKGROUND OF INVENTION a. Field of Invention

The invention relates generally to multi chambered dispensing devices capable of metering or proportioning the dispensed fluids. Particularly, the invention relates to a compact fluid dispenser capable of ejecting variable fluid volumes in response to operation of the dispenser, which is preferably by suitable manually applied force on a gimbaled selection and actuation disc.

b. Background of Invention

Visual artists may want to formulate color mixtures quickly and accurately, in order to be more productive in the often delicate, sequential and manual metering of paints. Through iterative use of the current dispenser, a mixture with any number or components in any proportion to each other may be produced. Disclosed herein is a volumetric dispenser which can repeatably produce specific fluid component formulations in response to actuation of an articulated selection and actuation disc, preferably by a manual depression of said disc.

c. Description of Related Art

Fluid dispensers which form a mixture from individual fluid components are known and are taught by Max Lieber's U.S. Pat. No. 6,527,201, by F. J. Fuchs Jr's U.S. Pat. No. 3,353,716, and by Girair Hagop Alticosalian's U.S. Pat. No. 4,006,841.

The above prior art devices are generally portable. Lieber's color changer requires a pneumatic power source to operate. This device generally has limitations in artistic exploitation because it can deliver only two colors simultaneously. Designed to deliver paint to an airbrush for real-time consumption, it constrains the visual appearance of the delivered mixture to narrow areas of the color gamut. For example, it cannot simultaneously deliver a mixture of light grey derived from a black and a white component together with a yellow component.

Fuchs Jr.'s device enables incremental mixture formation by manually actuating control knobs which correspond to particular fluid mixture components in order to dispense each fluid. The lack of proliferation and acceptance of this device today may be attributed to the number of parts it includes and the corresponding complexity of its manufacture. Paints may be viscous, non lubricating and may have high pigment loads. It is possible that F. J. Fuchs' device is prone to mechanical jamming of components which are in sliding contact with each other and are exposed to paint.

Alticosalian's dispenser allows for dispensing of as many as two fluids simultaneously from rigid pressurized containers via an arrangement of cams, valves and a shared fluid manifold. This device allows one to select a ratio between two fluids via a rotary knob. Dispensing of stored fluids is actuated by a manual depression of said knob. This device has marked disadvantages if used to dispense paints. It is not a volumetric dispenser, and appears to be semi stochastic in operation. A pressurized container is known to eject varying amounts of fluid in response to a given valve position over time. Pressurized containers are also known to begin dispensing with a surge of material. Furthermore, the prescribed central manifold may need cleaning upon fluid container replacement or color changes. A further disadvantage is the relative difficulty of refilling the advised pressurized containers in a home or studio setting. Finally, due to absence of means to clamp or secure the selected ratio during dispensing, mechanical flutter and inherent forces of dispensing may inadvertently alter the user selection, compromising repeatability and stability of the mixture produced by the device in question.

Notwithstanding the prior art, the present invention is neither taught nor rendered obvious thereby.

d. Objects and Advantages

An objective of the current invention is a compact, hand powered device that can store and meter out fluids simultaneously or sequentially.

Another objective of the current invention is to leverage artists' existing knowledge of a color wheel. To that end, device 100 includes three fluid paint stores c, m, y which may respectively contain Cyan, Magenta and Yellow, and are arranged in the notional positions of primary colors on a color wheel. The said fluid stores are located at equal lengths along periphery 2300 of body shell 2101 around a common axis 1300. In using the current invention, an operator may select any ratio of a first color component to a second component for dispensing.

Advantageously, the current invention accomodates a need to work with dozens of kinds of fluid materials. In airbrushing, for example, opaque and translucent paints, mediums, and paint reducers are used. A multitude of mediums and varnishes may be used with brushed-on acrylics. In anticipation of frequent changes of cartridges 3107, male-taper fittings 2009 are provided for coupling the said cartridges to dispenser 100. Because such Luer connections are generally easy to make and break, the said cartridges may be removed or installed with minimal operator effort using the said surfaces 2009.

The current device lends itself well to devising a catalog of the colors which it can produce because the user can specify fluid proportions incrementally using a scale and pointer system provided on the control disc and the device body. In one implementation of such a catalog, a set of mutually compatible and generic pigments is chosen in order to index their visual properties. Such a set may comprise of Cerulean Blue, Quinacridone Magenta, Cadmium Yellow, Titanium White, and Carbon Black. The resulting catalog may provide color codes, corresponding color samples, and relevant ratio or volume selections which may produce the said colors.

Another important object of the current invention is a valveless device which requires minimal maintenance and cleaning. Paints do not contact or wet any moving parts of the currently taught device. The only component which paints may contact is a disposable cartridge means 3107. The said cartridge means, preferably a syringe casing, can be cleaned and retained for future use.

Finally, the current invention provides clamping means to securely retain a selected dispensing ratio or volume.

SUMMARY OF INVENTION

The present invention relates to a fluid paint dispenser which enables the user to select from a plurality of mixture components prior to dispensing, for production of a wide variety of mixtures having different visual or other properties. The invention taught herein comprises of an articulated selection and actuation assembly 31, a plurality of fluid storage and delivery channels 32 arranged around a central axis 1300, and a main body 2101 to which the said assemblies 32 and 31 mount.

A threaded bore 2006 on main body 2101 is provided for mounting the said selection and actuation assembly 31, which comprises a selection and actuation disc 1101, a center block 1103, a rotary clamping bolt 1105 with integral hand grip 1102, and pins 1104 which secure the said disc to the said center block 1103. The said bore 2006, central to the main body and co-axial with axis 1300, receives a bolt 1105 integral to the said clamp means. Pins 1104 mount the said disc 1101 to the center block allowing it to rotate about an axis 1200. The said clamp bolt 1105 mounts the center block to the main body, allowing it to rotate about an axis 1300. In summary, the gimbaled assembly 31 provides mutually perpendicular rotary and tilt axes 1300 and 1200 about which said disc 1101 may articulate.

Selection and actuation disc 1101 may rotate with gimbal hub 1103, and during such rotation or when idle, may glide or rest on some or all of the piston cams 2001. Upon manual depression of said disc 1101 by the operator, in the vicinity and direction shown by arrow 10 in drawing 2, the said disc exerts a torque on pistons 2103 via their cam surfaces 2001 thereby also depressing the said pistons. The configuration of said disc 1101, said axes 1300 and 1200, and said piston cams 2001 is such that at most two piston cams 2001 may contact and follow said disc 1101 during an operator imparted actuation or tilting of disc 1101.

The rotary clamp 1102 is actuated by turning its handle in direction J, and when so engaged, resists flutter of the said disc 1101 relative to the body shell 2101 during dispensing. Another benefit of clamp 1102 is the retention of a prior dispensing selection until it is disengaged by operator. The said clamp may be disengaged by rotating handle in the opposite direction to that indicated by J.

Disc 1101 features upon it a graduated scale 4020 for selecting and dispensing two mixture components simultaneously at a specified ratio to each other, and a scale 4010 for dispensing variable volumes of a single mixture component. Each of the said scales corresponds with its particular set of indicators on the body shell 2101 and in concert allow the user to specify ratios or volumes of mixture components.

A dual component scale 4020 includes a series of graduated marks each denoting a certain proportion of a first to a second mixture component. The proportion graduations include marks 4021, 4022, and 4023 which may correspond to selectable ratios 1:29, 1:1 and 29:1, of a first to a second fluid. Said scale 4020 cooperates with proportion indicator markings 4001 located between fluid stores c, m, y and spaced at equal distances along rim 2300.

By rotating the said disc and bringing a desired ratio on its dual component scale 4020 to correspond with any one of the arrow indicators 4001 on the body shell 2101, engaging clamp 1102 and then depressing the disc above the said arrow 4001, the respective fluids from the fluid stores immediately flanking the particular indicator 4001 may be dispensed at the ratio indicated on scale 4020. In this manner, any two of the fluid components c, m, and y may be selected for simultaneous dispensing at a predetermined ratio.

A variable volume shot of a single kind of fluid may also be dispensed by the present invention. This feature may be used to modify an existing mixture with a single new fluid component. Single component scale 4010 comprises of a volumetric and a proportional series of graduations. The volumetric graduation elements 4044 are each equivalent to two 0.04 ml drops of fluid. Preferably, the said graduations 4044 are each rendered relatively smaller where a cumulatively lower volume is denoted, and are rendered relatively larger where there is a higher volume denoted. The said scale also features the proportional markings 4031, 4032, and 4033. Said scale 4010 cooperates with volume indicators 4002 located above fluid stores c, m, y and spaced at equal distances along rim 2300.

By rotating the selection and actuation disc 1101 and bringing a desired volume on its single component metering scale 4010 to correspond with the inset volume indicator 4002 on body shell 2101, engaging clamp 1102, then depressing the disc above indicator 4002, fluid in a cartridge under said indicator 4002 is caused to be ejected from an orifice 3105 of the same cartridge.

Each of the said channels 32 comprises of a cylindrical bore 2003 in communication with a fluid storage cartridge 3107, a quick release fitting 2102, a spring 2108, an end stop means 2104, and a piston 2103 slidably mounted in the said cylindrical bore. The main body 2101 preferably directly incorporates three said bores 2003 which each in turn accepting fitting 2102. The said fitting 2102 is in communication with the said fluid cartridge 3107 via bore 2113 as well as a multitude of considerably smaller apertures 2111. The said apertures 2111 serve to screen or protect the said piston and bore mechanism from contamination by the stored fluids during dispensing operation.

Functionally, each channel 32 is capable of ejecting a fluid volume corresponding to a linear displacement of its piston 2103. In one alternative implementation shown in FIG. 6, where each fluid channel is embodied by a disposable pipette, a fluid volume may be ejected upon compression of a particular pipette's bellows or perhaps bulb element.

The current device functions best when held upright with the clamp 1102 oriented away from the ground. The fluids 3103 held in the said cartridges 3107 must substantially cover cartridge orifices 3105 in order to be ejected in a controlled manner afforded by the current invention.

When no actuation forces act on the said piston 2103, the spring 2108 causes it to retract to a starting position where it is detained by pin 2104. Upon retraction of the said piston, air is caused to aspirate into the corresponding fluid cartridge 3107 until pressure in the said cartridge is in equilibrium with atmospheric pressure.

Prior to use of device 100, at least one cartridge 3107 must be filled with a fluid and pushed onto tapered surface 2009 of press-fit fitting 2102 as indicated by arrow kin FIG. 5 of the drawings. A female plug 3102 or a common push pin may be used for blocking cartridge orifice 3105 during the said filling operation and said push-on installation. It is advisable that elastomeric squeeze bottles with a tapered tip be used for the filling of cartridges. Such bottles may allow the user to orient and direct the flow of the new material and thereby to avoid contamination of the cartridge port 3106.

Prior to installation of cartridge means 3107, the piston in communication with said cartridge may be manually depressed, so as to relieve any pressure build-up caused inherently by the cartridge installation process. Upon fitment of the said cartridge to device 100, the piston is released and the cartridge is uncapped by operator.

Additional features, advantages, and embodiments of the invention may be set forth or apparent from consideration of the following detailed description. Moreover, it is to be understood that both the foregoing summary of the invention and the following detailed description are exemplary and intended to provide further explanation without limiting the scope of the invention.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF THE EMBODIMENTS

With reference to the drawings, a dispenser 100 is shown in accordance with an example embodiment and includes a number of components and assemblies that together provide various operational modes for selecting and dispensing a pair of liquids proportionally, or dispensing a single liquid individually, and include but are not limited to, a gimballed selection disc assembly 31, a main body 2101, one or more fluid storage and delivery channels 32, and a set of scale and indicator systems 4010 and 4020.

Figure 5:
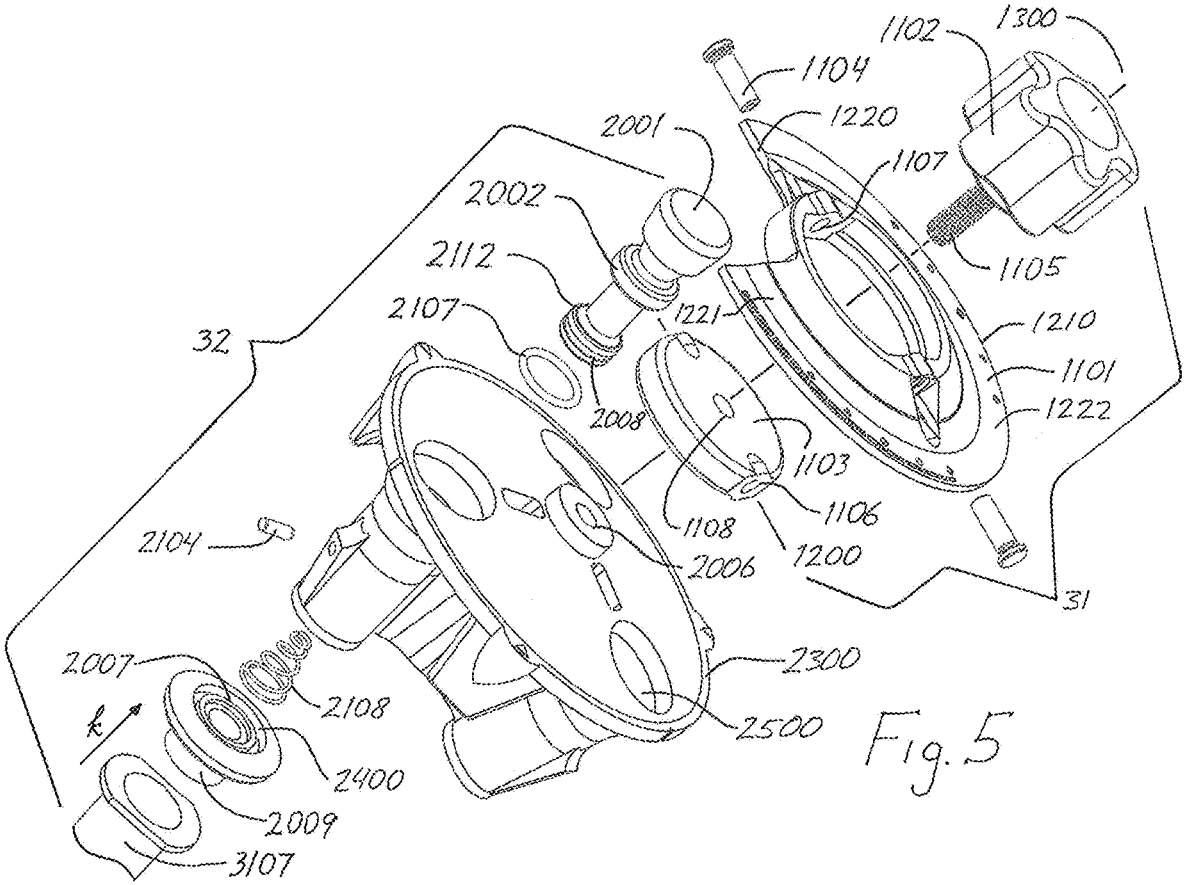
FIG. 5 is an exploded view of the fluid delivery device 100.

Referring to FIG. 5, a gimbal center block 1103 is mounted atop main body 2101 via a screw 1105 integral to clamping handle 1102, which passes through bore 1108 of said center block 1103 and engages a threaded central bore 2006 of the said main body 2101. The selector actuator disc 1101 mounts to gimbal center block 1103 via pins 1104 passing through bores 1107 and 1106 and may tilt on axis 1200 formed by said pins. The bolt 1105 provides a rotary axis 1300 about which the center block 1103 and disc 1101 mounted thereon may pivot.

In the current embodiment of dispenser 100, selection and actuation disc 1101 is bisected by tilt axis 1200, thereby forming a first section 1221 and a second section 1222. The said first section 1221 of said disc 1101 bears a cutaway 1220 which prevents overlap of more than one piston cam 2001 by said section's available net contact area. Thus the said cutaway 1220 permits selection of and dispensing of at most one mixture component c, m, or y from device 100 when an actuating force acts upon the the said first section 1221. Section 1222 of disc 1101 is capable of actuating two pistons simultaneously when it covers or overlaps two cam poles 2400 of the said pistons. Disc section 1221 carries upon it a single component scale 4010, and disc section 1222 carries upon it a dual component scale 4020.

Figure 1:
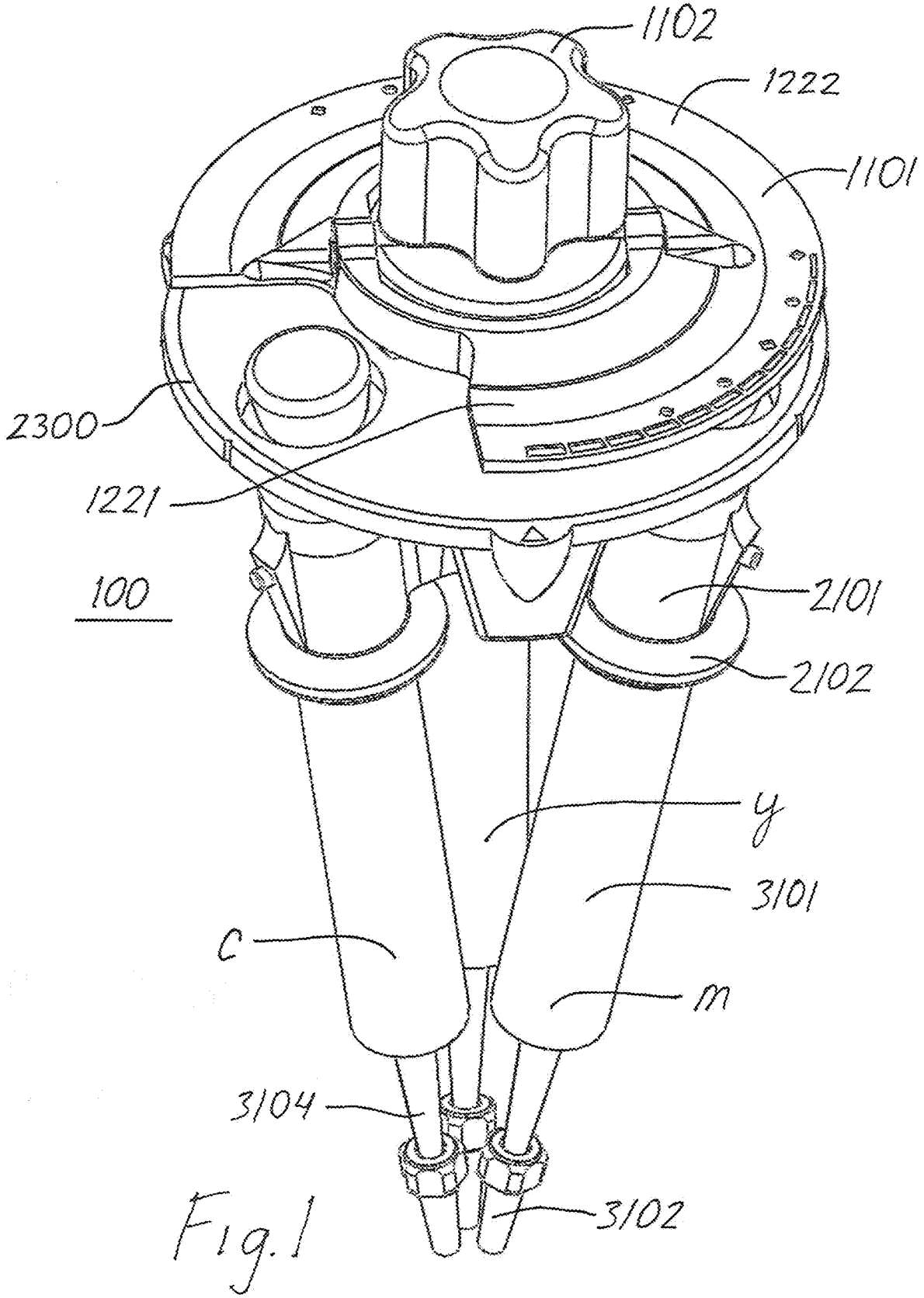
FIG. 1 is a general three quarters view of the fluid delivery device 100.
Figure 2:
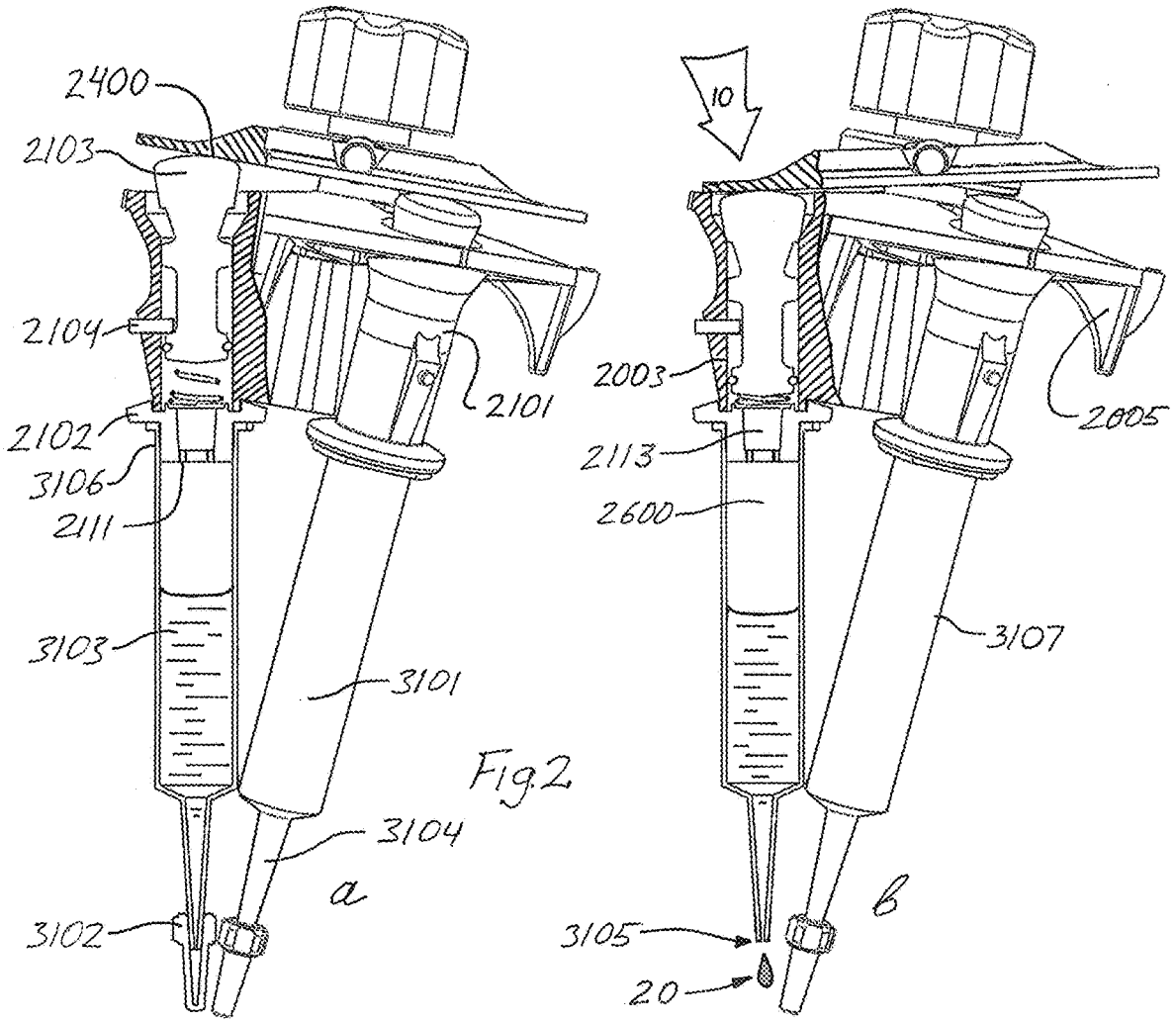
FIG. 2 is a partial cutaway of the fluid delivery device 100.
Figure 3:
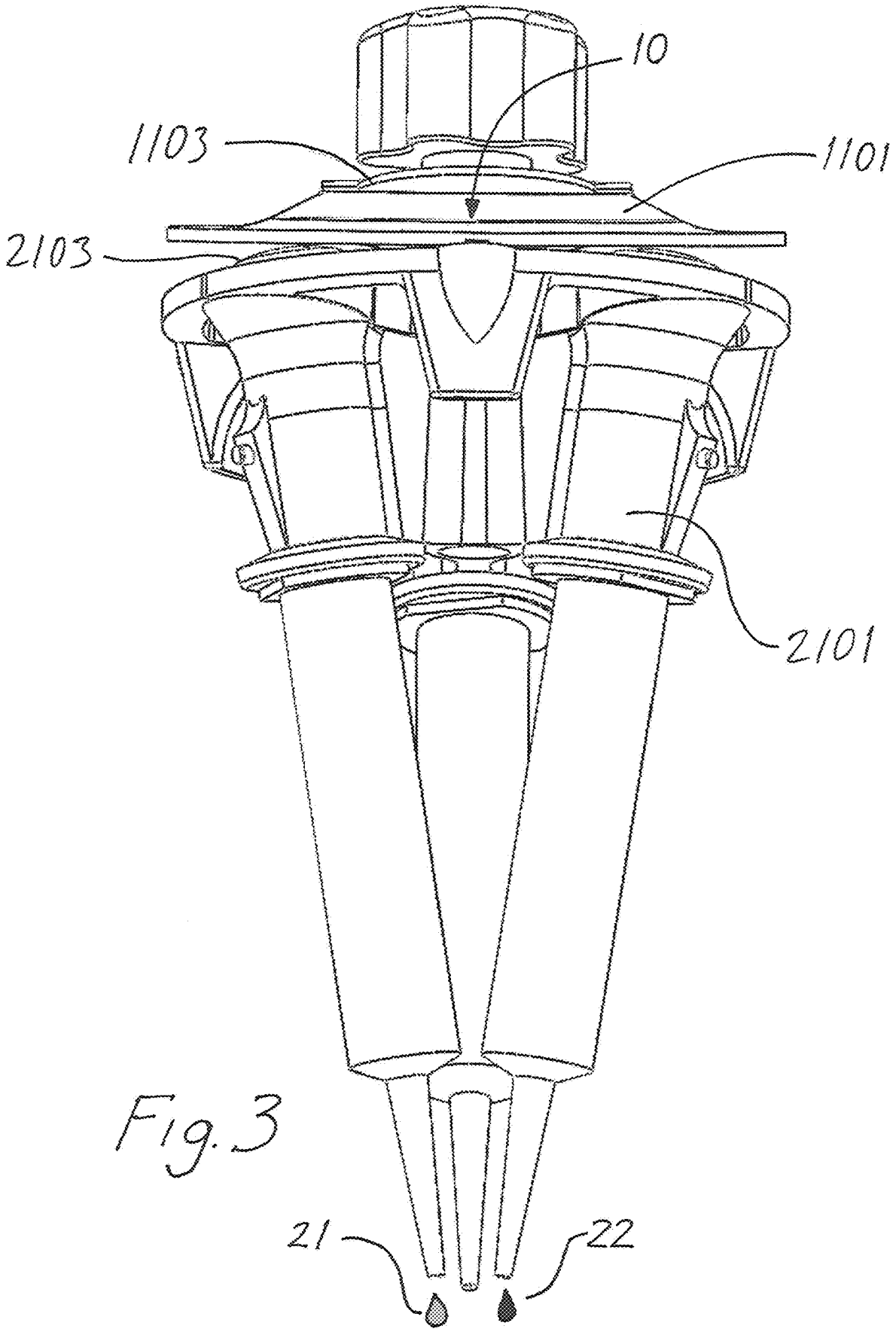
FIG. 3 shows a view of the fluid delivery device 100 mid-cycle during simultaneous fluid dispensing.
Figure 4:
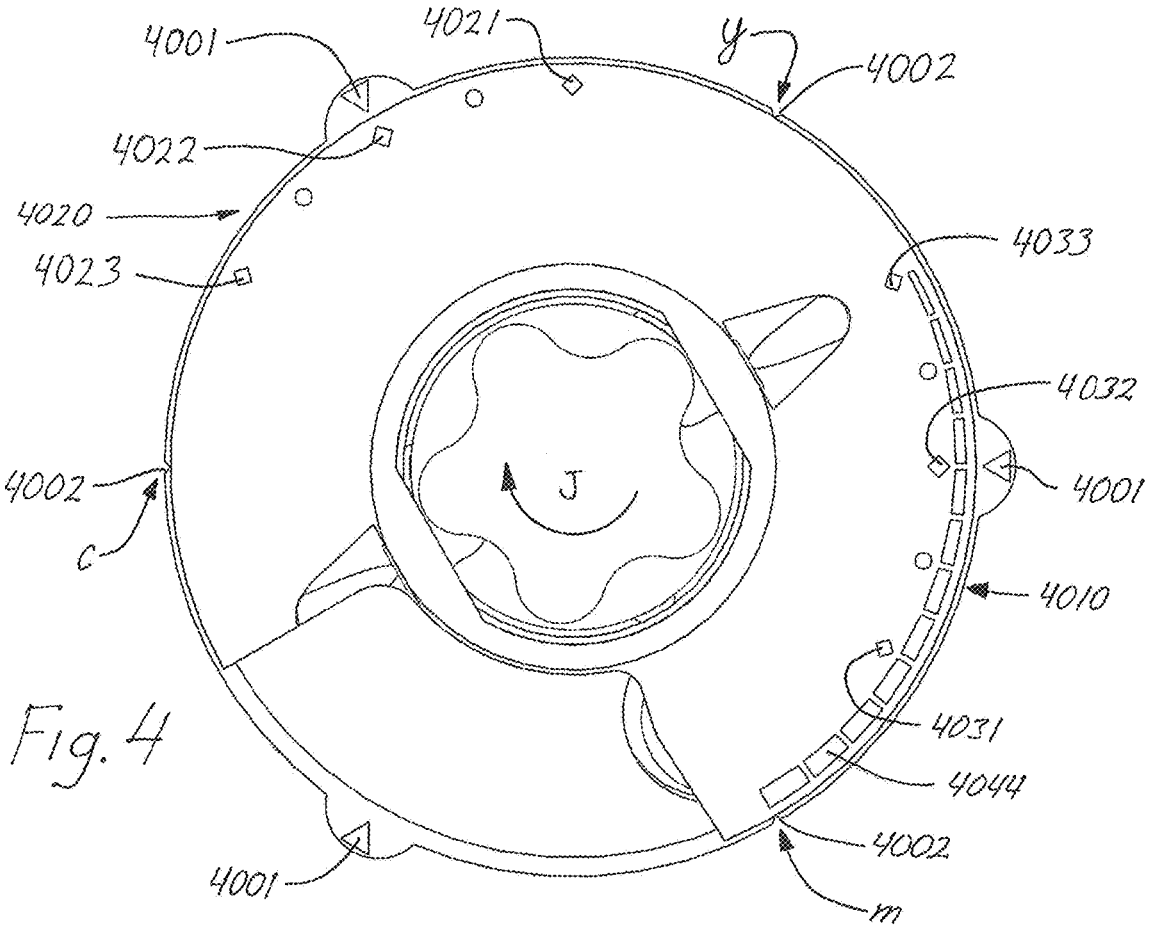
FIG. 4 is a top view of fluid delivery device 100 showing scale and pointer markings.

Turning to FIGS. 1, 2, and 5, we find a fluid storage and delivery channel comprising of a fluid storage cartridge 3107, a quick release fitting 2102, a spring 2108, an end stop means 2104, and a piston 2103 slidably mounted in a cylindrical bore 2003. The said bore 2003 is preferably formed in main body 2101, and is in fluid communication with an interchangeable cartridge 3107 via fluid pathways 2111 and 2113 of fitting 2102. Each piston's bearing 2002 and piston head 2112 are in frictional contact with bore 2003. The piston seal 2107 is installed in groove 2008 on piston head 2112. Piston 2103, piston bore 2003, piston seal 2107, fluid passages 2111 and 2113, and cartridge 3107 define a variable volume 2600 which may be reduced when movement is imposed upon piston 2103 by actuation and selection means 31.

Each fluid channel assembly 32 is arranged along the periphery 1210 of the selection and actuation disc 1101 at equal intervals in order to maximize any motion imparted to pistons during a stroke of said disc 1101. The said fluid channel means 32 are arranged symmetrically about axis 1300. One or more of the piston cams 2001, disposed at a substantially tangential orientation to said disc 1101, may maintain positive contact with disc 1101 througout a dispense cycle.

Diaphragms, bellows, and rubber bulbs are widely used for pippetting or transferring fluids. The said rubber bulbs generally interoperate with pipette bodies, and disposable pipettes often feature an integrated bellows or bulb. These devices functionally provide similar utility to the presently taught fluid channel 32, and can similarly eject fluid from a storage means volumetrically, in a controlled manner.

Figure 6:
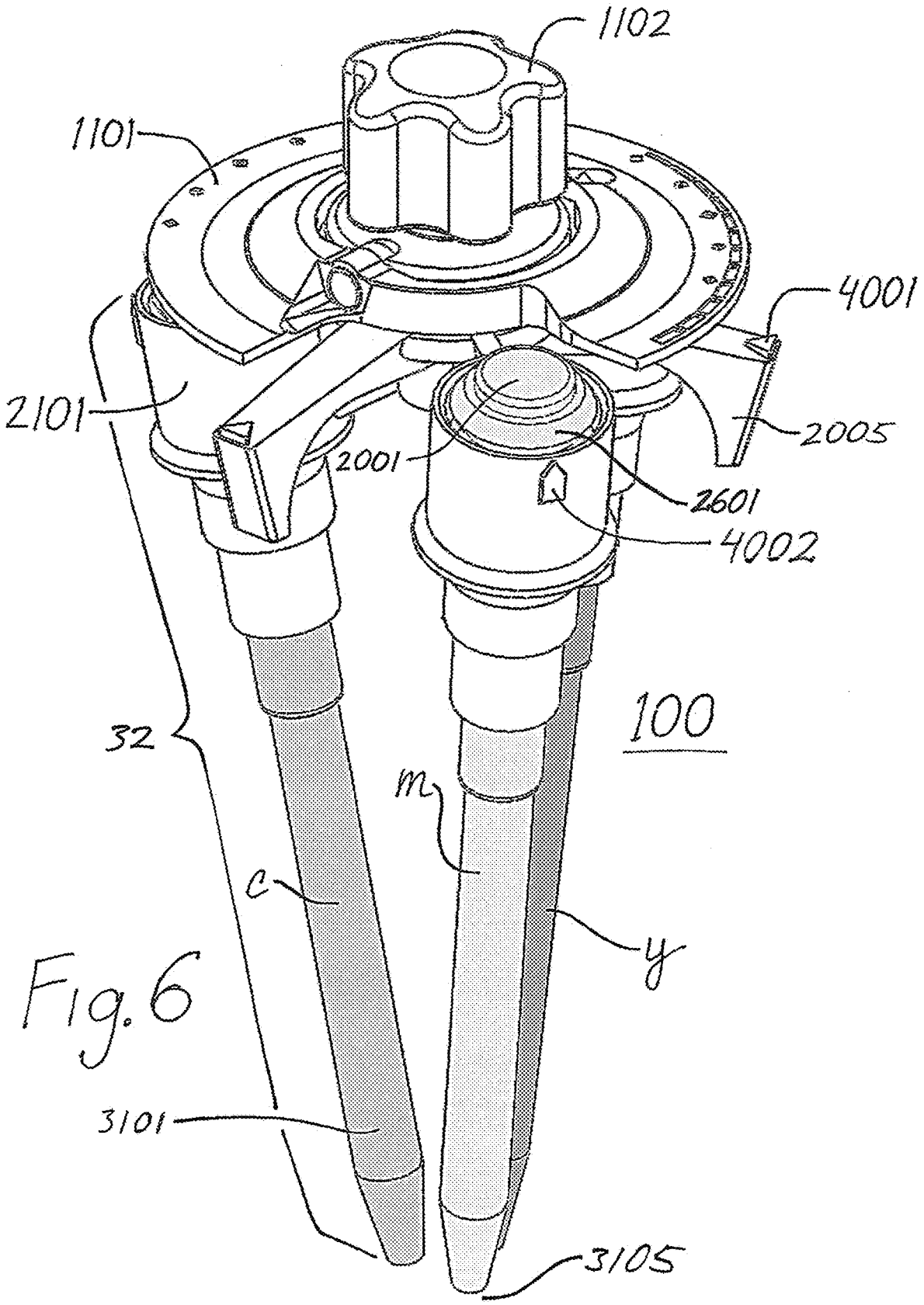
FIG. 6 is a general three quarters view of an alternative embodiment of device 100.

As illustrated in FIG. 6, a bellows pipette may comprise one alternative to the presently taught piston, cylinder and cartridge arrangement and can provide a compliant variable volume 2601 analogous to volume 2600, as well as an integrated fluid store c, and present a simplified fluid delivery channel 32. Bellows pipettes may provide an integral cam surface 2001 for interacting with selection and actuation disc 1101, and a fluid storage volume 3101 equipped with an ejection orifice or tip 3105.

Those skilled in the art shall know how to incorporate the said various alternative fluid delivery and storage devices into the present invention 100. Drawing 6 shows an example of an alternate embodiment which uses a disposable pipette as a fluid storage and delivery means.

The current device offers some design freedom in the packaging of the collapsible volume such as a bellows or diaphragm with the implementer's preferred fluid store or cartridge. A pneumatic conduit must link the two said volumes. Thus, should the implementer choose a discrete bellows as a collapsible element, it is highly advantageous to install an internal spring within the said element in order to speed expansion of its form after dispensing and to prevent unwanted or sporadic collapse of the said element's volume due to the weight of the stored fluid and the associated negative pressure exerted internally on the said collapsible volume. Preferably, a helical compression spring is installed along the axis of compression of the designer's preferred collapsible element.

In FIG. 2, drawing a, the selection and actuation disc 1101, piston 2103 and spring 2108 are shown in their initial as well as final positions in a dispense cycle. In FIG. 2, drawing b, the same elements are shown at the mid-point in the dispense cycle, when the selected fluids have been ejected. In operation, at least one piston 2103 is caused to travel in a piston bore 2003 towards a fitting element 2102 terminating said bore, to an extent determined by the rotary position of the gimbal hub and an inclination of the said disc 1101. The user may manually depress said disc 1101 in the vicinity of and in the direction indicated by arrow 10 to affect dispensing of one or more stored fluid 3103. The tilting of selection disc 1101 on axis 1200 may then proceed until the top surface 2110 of body shell 2101 is contacted by said disc. During such a stroke, air pressure increases in constrained volume 2600 as piston 2103 is displaced by disc 1101 towards cartridge 3107, causing the said cartridge to eject fluid. In its travel, piston 2103 compresses spring 2108, which serves to return the said piston to its initial or resting position at the end of an actuation stroke. Upon retraction of said piston, air may be aspirated into syringe main body 3103 via tapered tip 3104, in order to replace the ejected fluid. Once said ejected fluid is replaced with air, a dispense cycle is understood to be complete.

In reference to FIGS. 2 and 5, springs 2108 are received by a spring seat 2007 of each fitting 2102. If piston 2103 is caused to travel towards fitting 2102, spring 2108 will be compressed, and able to exert sufficient force to return piston 2103 to an initial position determined by end-stop pin 2104. Pins 2104 in concert with springs 2108 establish initial or at-rest positions of pistons 2103.

Functionally the bearing 2002 stabilizes the piston and resists lateral forces imparted on it by selection and actuation means 31, which may cause binding of bearing 2002 to its bore 2004 during operation of device 100. Those skilled in the art will know how to implement bearing 2002. The fitting 2102 mates to the main body 2101 via a relief groove 2400 and spring seat rim 2007. Spring seat rim 2007 is accepted by piston bore 2003 for alignment. Preferably the elements 2101 and 2102 are bonded with glue.

Seal 2107 aids in defining variable volume 2600. The seal is preferably produced from a PTFE enhanced elastomer. Substantial chemical resistance of seal 2107 to lubricants is important to the current embodiment. It is advised to maintain lubrication of the said sliding seal 2107

The current embodiment favors a disposable syringe casing 3107 with an integral tapered tip 3104 as a fluid store. Tapered tip 3104 allows for smooth aspiration of air back into the syringe after a volume of fluid is ejected. To facilitate unimpeded transit of air into the main casing upon piston 2103 retraction, a syringe casing with a smooth and contiguous interior surface is preferable.

The tips 3104 of the fluid stores 3101 are preferably arranged in substantially close proximity to each other, in order to dispense the stored fluids into a relatively small receptacle or container. It is preferred that the piston cams 2001 are situated as close to the periphery 2300 of device 100 as possible, in order to increase the distance over which any tilting of the selection and actuation disc 1101 may interact with the said cams.

The invention claimed is:

1. A fluid dispensing device for delivering one or more fluids, comprising a main body adapted for mounting or incorporating one or more fluid delivery channels;

a fluid volume selection and actuation means mounted to said main body and operable to cause the release of a desired quantity of a fluid or fluids from the said one or more fluid delivery channels;

wherein the said selection and actuation means is rotatable in relation to the said main body on one axis in order to specify a fluid volume or volumes to eject, and tiltable relative to the said body on another axis in order to effect the ejection of fluid from the one or more of the fluid channels; and wherein the said volume selection and actuation means can be fixed in place by the provided clamp bolt or clamping means;

at least one fluid delivery channel having a fluid storage or cartridge equipped with at least a fluid ejection port and a control port or orifice;

a normally expanded, collapsible piston which exposes a control cam surface and is in fluid communication with said cartridge; wherein the said cam surface is at rest situated in close proximity to the selection and actuation means, so that upon displacement of the selection and actuation means, said piston may be collapsed via said cam surface.

2. A fluid dispensing device as claimed in claim 1, wherein the selection and actuation means is symmetrically bisected into a first and a second section by a tilt axis, and the first section bears a cutaway which prevents its available contact area from contacting plural control cams, thereby guaranteeing that only one fluid may be dispensed should the said section be depressed to effect the ejection of fluid.

3. A selection and actuation disc as claimed in claim 2, wherein the second section is a non-cutaway section, which bears a ratio-metric proportion scale denoting a range of the possible mutual proportions of two fluids, and wherein the said scale cooperates with at least one proportion selection indicator marking located on the main body.

4. A fluid dispensing device, comprising:

a main body mounted to or comprising at least one fluid delivery channel, a volumetric selection mechanism, and an actuation mechanism configured to release an amount of liquid selected by the volumetric selection mechanism;

said volumetric selection mechanism and said actuation mechanism each being rotatable with respect to said main body on a first axis and tiltable relative to the said body on a second axis;

a clamping mechanism selectively fixedly holding said volume selection mechanism and said actuation mechanism in place relative to said main body;

said fluid delivery channel further comprising:

a fluid storage region further comprising at least a fluid ejection port and a control port;

a collapsible region which is in fluid communication with said fluid storage region and comprises a variable volume and a control cam surface;

wherein tilting about the said second axis of the said volumetric selection mechanism and said actuation mechanism causes ejection of at least one fluid from the said fluid storage region, due to interaction between said control cam surface and the said actuation mechanism.

5. The fluid dispensing device as claimed in claim 4, wherein said volumetric selection mechanism and said actuation mechanism are bisected into a first and a second section by a tilt axis, and said first section further comprises a cut-away region which prevents contact with a control cam which comprises said control cam surface.

6. The fluid dispensing device of claim 5, wherein said second section of said volumetric selection mechanism and said actuation mechanism comprise a ratio-metric proportion scale denoting a range of the possible proportions of two fluids using upper, lower and median ratio markings, and where said proportion scale is further placed on an exterior side of said second section with at least one proportion indicator marker located on the main body.

7. A selection and actuation disc as claimed in claim 5, wherein the said cut-away section bears a volumetric scale denoting progressively increasing shot volumes of a fluid, and where the said scale cooperates with at least one volume indicator marker located on the main body.

* * * * *